United States Patent [19]

Popescu

[11] 4,226,682

[45] Oct. 7, 1980

[54] BRIGHTENERS FOR ELECTROLYTIC ACID ZINC BATHS

[76] Inventor: Francine Popescu, 27, rue du Centre, 94490 Ormesson, France

[21] Appl. No.: 13,189

[22] Filed: Feb. 16, 1979

[30] Foreign Application Priority Data

Feb. 17, 1978 [FR] France ..... 78 04508

[51] Int. Cl.[2] ..... C25D 3/22

[52] U.S. Cl. ..... 204/55 R

[58] Field of Search ..... 204/55 R, 43 Z, 114, 204/123

[56] References Cited

U.S. PATENT DOCUMENTS

| | | | |
|---|---|---|---|
| 3,669,854 | 6/1972 | Harbulak | 204/55 R |
| 3,891,520 | 6/1975 | Todt et al. | 204/55 R |
| 4,014,761 | 3/1977 | Passal | 204/55 R |
| 4,100,040 | 7/1978 | Rosenberg | 204/55 R |
| 4,119,502 | 10/1978 | Arcilesi | 204/55 R |

FOREIGN PATENT DOCUMENTS

| | | | |
|---|---|---|---|
| 30319 | 1/1973 | Australia | 204/55 R |
| 1524719 | 4/1968 | France . | |

*Primary Examiner*—G. L. Kaplan

*Attorney, Agent, or Firm*—Gifford, VanOphem, Sheridan & Sprinkle

[57] ABSTRACT

Brighteners for electrolytic acid zinc baths having the general formula:

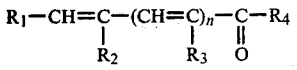

About 0.05 to 2.0 grams brightener are added for every liter of zinc bath to produce bright ductile zinc electrodeposits. Several types of wetting agents are used as dispersants in the zinc bath which has a pH of about 3.0 to 6.8. Other known brighteners may be added to the bath to obtain variations of the quality of the zinc deposits.

9 Claims, No Drawings

BRIGHTENERS FOR ELECTROLYTIC ACID ZINC BATHS

BACKGROUND OF THE INVENTION

This invention relates to the electrolytic deposition of bright zinc from aqueous acidic zinc electroplating baths and, more particularly, to new brighteners and addition agents useful in bright acid zinc electroplating.

SUMMARY OF THE INVENTION

According to one aspect of this invention, bright, uniform and ductile zinc electrodeposits are obtained by making a metallic object cathode in an electroplating zinc bath comprising essentially:

(a) an aqueous solution of zinc ions of a pH comprised between 3.5 and 6.8;

(b) a dispersing agent compatible with said bath; and (c) a brightener dispersed in said bath and corresponding to the general formula:

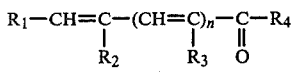

(I)

wherein:

$R_1$ is phenyl, pyridyl or naphthyl radical and may have one or several substituents selected from hydroxy, chloro, bromo, alkyl, alkoxy, carboxy, amino, amido or methylenedioxy;

$R_2$ and $R_3$ are, independently one of another, hydrogen, hydroxy or methyl;

n is zero or 1; and $R_4$ is alkyl, hydroxyalkyl or pyridyl (with the exception of the methyl when $R_1$ is phenyl, $R_2$ is hydrogen and n is zero).

The concentration of the brighteners of formula (I) in the zinc plating bath is comprised between 0.05 and 2.0 grams per liter of bath, preferably between 0.1 and 0.7 g/l.

The Table I gives nonlimiting examples of compounds of formula (I) which may be utilized as zinc electroplating brighteners, according to this invention.

TABLE I.

COMPOUNDS OF FORMULA (I)

| COMPOUND | Optimum concentration in the zinc plating bath g/l |
|---|---|
| (1) 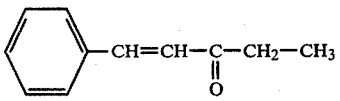 1-phenyl-1penten-3-one | 0.1–0.4 |
| (2) 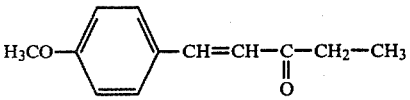 1-(p-methoxyphenyl)-1-penten-3-one | 0.05–0.3 g/l |
| (3) 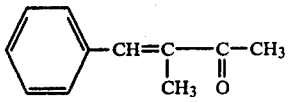 3-methyl-4-phenyl-3-buten-2-one | 0.1–0.5 |
| (4) 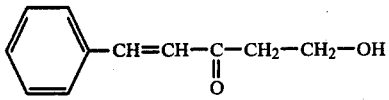 1-phenyl-5-hydroxy-1-penten-3-one | 0.1–0.4 |
| (5) 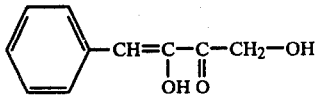 1-phenyl-2,4-dihydroxy-1-buten-3-one | 0.2–0.7 |
| (6) 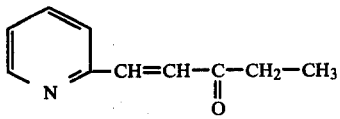 1-(2-pyridyl)-1-pentene-3-one | 0.08–3.5 |
| (7) 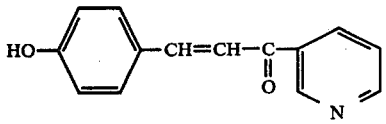 1-(p-hydroxyphenyl)-3-(3-pyridyl)-1-propen-3-one | 0.1–0.6 |
| (8) 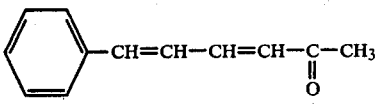 6-phenyl-hexadienone-2 | 0.05–2.0 |
| (9) 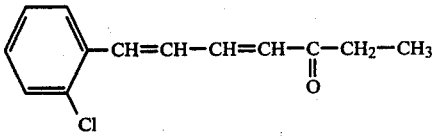 7-(o-chlorophenyl)-heptadienone-3 | 0.05–3.0 g/l |
| (10) 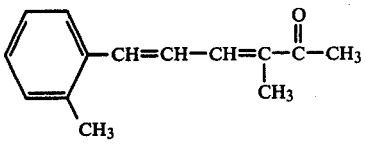 3-methyl-6-(o-methylphenyl)-hexadienone-2 | 0.05–0.5 |
| (11) | |

TABLE I.-continued

| COMPOUNDS OF FORMULA (I) COMPOUND | Optimum concentration in the zinc plating bath g/l |
|---|---|
| 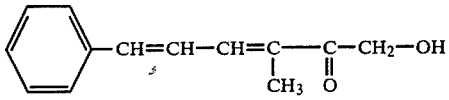 1-hydroxy-3-methyl-6-phenyl-hexadienone-2 (12) | 0.1–0.6 |
| 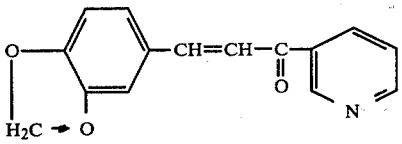 3-(3-pyridyl)-1-piperonyl-1-propen-3-one (13) | 0.05–0.9 |
| 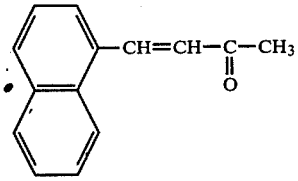 1-(1-naphthyl)-1-buten-3-one | 0.1–1.0 |

The brighteners of formula (I) having little or no water solubility, one or several dispersing agents are added to the plating bath in order to obtain a homogeneous dispersion of said brighteners.

According to this invention, dispersing agents belonging to the following classes may be used to disperse the compounds of formula (I) in the plating bath:

(A) nonionic and anionic wetting agents derived from ethylene oxide and/or propylene oxide: ethoxylated alkyl phenols, ethoxylated naphtols, ethoxylated fatty alcohols, sulphated ethoxylated fatty alcohols, sulphated ethoxylated alkylphenols, copolymers of ethylene oxide with propylene oxide.

(B) amphoteric wetting agents derived from alkylimidazolines.

(C) water soluble synthetic polymers: polyvinylpyrrolidone, polypropyleneglycols, homopolymers of acrylamide, polyethyleneimines.

These dispersing agents are added in the zinc electroplating bath in concentration of 0.1 to 30 grams per liter of bath, preferably of 1.0 to 15 g/l.

Table II gives nonlimiting examples of dispersing agents suitable to perform the objects of this invention.

TABLE II

| DISPERSING AGENTS COMPOUND | Optimal concentration in the zinc plating bath, g/l |
|---|---|
| (1) Ethoxylated nonylphenol with 15 moles of ethylene oxide in its molecule | 2–8 g/l |
| (2) Ethoxylated beta-naphtol with 20 moles of ethylene oxide in molecule | 4–12 |
| (3) Ethoxylated fatty alcohol C12–C14 with 11 moles of ethylene oxide | 2–8 |
| (4) Ethoxylated oxo-alcohol $C_9$–$C_{11}$ with 10 moles of ethylene oxide | 3–10 |
| (5) Ethoxylated oleic alcohol with 12 moles of ethylene oxide | 5–15 |
| (6) Sulphated linear fatty alcohol $C_{12}$–$C_{14}$ ethoxylated with 20 moles of ethylene oxide | 2–8 |
| (7) Sulphated ethoxylated octylphenol with 12 moles of ethylene oxide | 4–10 |
| (8) Copolymer of ethylene oxide with propylene oxide at 80% ethylene oxide | 2–8 |
| (9) Polyvinylpyrrolidone of molecular weight comprised between 5,000 and 360,000 | 1–10 |
| (10) Polyacrylamide of molecular weight comprised between 30,000 and 3,000,000 | 1–10 g/l |
| (11) Polyethyleneimine of molecular weight comprised between 200 and 10,000 | 0.5–7 |

The zinc electroplating baths in conformity with this invention comprise an aqueous solution of zinc ions i.e. an aqueous solution of a zinc salt like the zinc chloride, sulphate, acetate, sulphamate, or fluoborate, in concentration of 10 to 200 grams per liter of bath. Apart from the zinc salt, these baths further comprise 1 to 50 grams per liter of a pH buffering compound like boric acid, citric acid or tartaric acid, and 5 to 200 grams per liter of a conductivity salt selected from alkaline or ammonium chlorides (sodium chloride, potassium chloride, lithium chloride, ammonium chloride).

To this basic solution, there are added the addition agents described in the present invention, namely at least one dispersing agent compatible with the plating bath, in concentration of 0.1 to 30 g/l and at least one brightener of formula (I), in concentration of 0.05 to 2.0 grams per liter of bath.

The pH of the bath is, preferably, comprised between 4.5 and 5.5, but it may vary from 3.0 to 6.8.

To obtain bright zinc electrodeposits, a metallic object is made cathode in the above described bath, at a cathodic current density comprised between 0.5 and 7.0 A/dm$^2$ and by using a zinc anode.

According to another aspect of this invention, one may associate the above described brighteners with other brighteners or addition agents known in the art, in order to obtain a certain variation of the qualities of the zinc deposit, but still remaining, by this association, within the limits of this invention.

The following classes of compounds may be, in this way, advantageously associated with the brighteners described in this invention:

(1) aromatic monocarboxylic acids with the carboxyl group directly linked to the aromatic nucleus and having the general formula:

$$R_A-\underset{\underset{O}{\|}}{C}-O-Me \qquad \text{(II)}$$

wherein:

$R_A$ represents a phenyl, pyridyl, furyl, thienyl or naphtyl radical which may comprise substituents like hydroxy, alkoxy, alkyl, chloro, bromo, amino, amido, methylenedioxy or carbonyl $$(-\underset{\underset{O}{\|}}{C}H);$$

and

Me is hydrogen or an alkaline metal.

The concentration of these aromatic acids or their salts in the zinc plating bath may vary between 0.1 and 20 grams per liter of bath, preferably 1.0 to 6.0 g/l.

Nonlimiting examples of acids of formula (II) are: benzoic acid, anisic acid, nicotinic acid, furoic acid, thenois acid, salicylic acid, piperonylic acid, vanillic acid, terephtalic acid-aldehyde, etc. or their sodium, potassium, lithium, ammonium or zinc salts.

(2) aromatic aldehydes of the general formula:

$$R_B-\underset{\underset{O}{\|}}{C}-H \qquad \text{(III)}$$

wherein:

$R_B$ is a phenyl, pyridyl, naphtyl, furyl, thienyl or piperonyl radical which may comprise one or several substituents like alkyl, alkoxy, hydroxy, chloro, bromo, methylamino or dimethylamino.

These aldehydes are added in the acid zinc plating bath in concentration of 0.05 to 2.0 grams per liter of bath.

Nonlimiting examples of aldehydes of formula (III) are: benzoic aldehyde, anisic aldehyde, pyridyl-2-aldehyde, furfural, 1-naphtaldehyde, salicylic aldehyde, etc.

Particularly favorable, according to this invention, is the association of the brighteners of formula (I) with the acids of formula (II); in this way, the uniformity and the brilliance of the zinc deposits are enhanced.

DESCRIPTION OF THE PREFERRED EMBODIMENTS

The following examples illustrate, in a nonlimiting manner, the application of this invention:

EXAMPLE 1

A zinc electroplating bath of the following composition is prepared:

Zinc chloride . . . 100 g/l
Potassium chloride . . . 220 g/l
Boric acid . . . 25 g/l
and the pH of this bath is corrected to 5.0.

EXAMPLE 2

In the zinc electroplating bath of example 1, there is added:

Compound No. 1 of Table II . . . 20 g/l
Compound No. 1 of Table I . . . 0.3 g/l

Electrolysing this bath at a temperature of 20°–30° C., at a cathodic current density of 0.5 to 5.0 A/dm$^2$ and under cathodic agitation there are obtained bright and ductile zinc electrodeposits, with a good throwing power.

In order to facilitate the dispersion of the brighteners of formula (I) in the zinc plating bath, one may use them, preferably, in the form of an alcoholic solution of 10 to 20 percent concentration.

EXAMPLE 3

In the bath of example 1, there is added:

Compound No. 2 of Table II . . . 5 g/l
Compound No. 5 of Table II . . . 10 g/l
Compound No. 2 of Table I . . . 0.2 g/l
Compound No. 6 of Table I . . . 0.2 g/l In the same conditions as for the example 2, there are obtained very bright and ductile zinc electrodeposits.

EXAMPLE 4

In the bath of example 1, there is added:

Compound No. 1 of Table II . . . 7 g/l
Compound No. 3 of Table II . . . 9 g/l
Compound No. 1 of Table I . . . 0.4 g/l
Benzoic acid . . . 5 g/l Very bright, uniform and ductile zinc electrodeposits are obtained in the same conditions of electrolysis as for the example 2.

EXAMPLE 5

A bright zinc electroplating bath of the following composition is prepared:

Zinc sulfate ($SO_4Zn.H_2O$) . . . 150 g/l
Ammonium chloride . . . 50 g/l
Boric acid . . . 20 g/l
Citric acid . . . 3 g/l
Compound No. 4 of Table II . . . 10 g/l
Compound No. 4 of Table I . . . 0.3 g/l
Anisic acid . . . 4 g/l Bright, uniform and ductile zinc electrodeposits are obtained from this bath at 0.5–5.0 A/dm$^2$ cathodic current density, 20°–30° C. temperature, pH 4.5–5.5 and cathodic agitation.

EXAMPLE 6

In the bath of example 1, there is added:

Compound No. 8 of Table I . . . 0.1 g/l
Compound No. 3 of Table I . . . 0.1 g/l
Compound No. 1 of Table II . . . 7.0 g/l
Compound No. 6 of Table II . . . 1.0 g/l
Polyvinylpyrrolidone of molecular weight 30,000 . . . 1.0 g/l
p-Hydroxybenzoic acid . . . 4.0 g/l
Terephtalic acid-aldehyde . . . 0.1 g/l The zinc electrodeposits obtained from this bath, in the same conditions as for the preceding example, are very bright, levelled, uniform, and ductile.

The present invention is not limited to the preceding examples and tables, numerous other variants being realizable by one skilled in the art, by utilizing the general formulae (I), (II) and (III) and the indications given in the above description.

What I claim is:

1. A bright zinc electroplating bath comprising an aqueous acidic solution of zinc ions and:

(a) 0.1 to 30.0 grams per liter of a dispersing agent compatible with said bath; and, (b) 0.05 to 2.0 grams per liter of a brightener of general formula:

$$R_1-CH=\underset{\underset{R_2}{|}}{C}-(CH=\underset{\underset{R_3}{|}}{C})_n-\underset{\underset{O}{\|}}{C}-R_4 \qquad \text{(I)}$$

wherein:

$R_1$ is a phenyl, pyridyl or naphthyl radical which may comprise one or several substituents selected from: hydroxy, chloro, bromo, alkyl, alkoxy, carboxy, amino, amido or methylenedioxy;

N is zero or 1

$R_2$ is hydrogen, hydroxy or methyl when n is 1;

$R_2$ is hydroxy or methyl when n is zero;

$R_3$ is hydrogen, hydroxy or methyl;

$R_4$ is an alkyl of at least two carbon atoms, hydroxyalkyl or pyridyl when $R_1$ is phenyl, $R_2$ is hydrogen and n=0; and $R_4$ is alkyl, hydroxyalkyl or pyridyl in any other case.

2. A zinc electroplating bath as claimed in claim 1 wherein said dispersing agent is a nonionic wetting agent derived from ethylene oxide.

3. A zinc electroplating bath as claimed in claim 2 wherein said dispersing agent is selected from the group consisting of: ethoxylated nonylphenol with 15 moles of ethylene oxide; ethoxylated oleic alcohol with 11 moles of ethylene oxide; ethoxylated octylphenol with 20 moles of ethylene oxide; ethoxylated betanaphtol with 20 moles of ethylene oxide and polyvinylpyrrolidone having a molecular weight of about 30,000.

4. A zinc electroplating bath as claimed in claim 1 wherein said dispersing agent is an anionic wetting agent derived from ethylene oxide.

5. A zinc electroplating bath as claimed in claim 1 and further comprising 0.1 to 20.0 grams per liter of an aromatic monocarboxylic acid with the carboxyl group directly linked to the aromatic nucleus.

6. The bath as claimed in claim 5 wherein said aromatic acid is selected from the group consisting of: benzoic acid, anisic acid, nicotinic acid, salicylic acid, and terephtalic acid-aldehyde.

7. A method of electroplating bright zinc comprising making a metallic object, the cathode in an aqueous acidic electroplating bath, said bath comprising zinc ions and:

(a) 0.1 to 30.0 grams per liter of a dispersing agent compatible with said bath; and, (b) 0.05 to 2.0 grams per liter of a brightener of general formula:

$$R_1-CH=\underset{\underset{R_2}{|}}{C}-(CH=\underset{\underset{R_3}{|}}{C})_n-\underset{\underset{O}{\|}}{C}-R_4 \qquad (I)$$

wherein:

$R_1$ is a phenyl, pyridyl or naphthyl radical which may comprise one or several substituents selected from: hydroxy, chloro, bromo, alkyl, alkoxy, carboxy, amino, amido or methylenedioxy;

n is zero or 1;

$R_2$ is hydrogen, hydroxy or methyl when n is 1;

$R_2$ is hydroxy or methyl when n is zero;

$R_3$ is hydrogen, hydroxy or methyl;

$R_4$ is an alkyl of at least two carbon atoms, hydroxyalkyl or pyridyl when $R_1$ is phenyl, $R_2$ is hydrogen and n=0; and $R_4$ is alkyl, hydroxyalkyl or pyridil in any other case.

8. A bright zinc electroplating bath comprising an aqueous acidic solution of zinc ions and:

(a) 0.1 to 30.0 grams per liter of a dispersing agent compatible with said bath; and (b) 0.05 to 2.0 grams per liter of the brightener 3-methyl-4-phenyl-3-buten-2-one.

9. A bright zinc electroplating bath comprising an aqueous acidic solution of zinc ions and:

(a) 0.1 to 30.0 grams per liter of a dispersing agent compatible with said bath; said dispersing agent being selected from the group consisting of: Sulphated ethoxylated fatty alcohol $C_{12}$–$C_{14}$ with 20 moles of ethylene oxide and sulphated ethoxylated octylphenol with 12 moles of ethylene oxide; and (b) 0.05 to 2.0 grams per liter of a brightener of the general formula:

$$R_1-CH=\underset{\underset{R_2}{|}}{C}-(CH=\underset{\underset{R_3}{|}}{C})_n-\underset{\underset{O}{\|}}{C}-R_4 \qquad (I)$$

wherein:

$R_1$ is a phenyl, pyridyl or naphthyl radical which may comprise one or several substituents selected from: hydroxy, chloro, bromo, alkyl, alkoxy, carboxy, amino, amido or methylenedioxy;

$R_2$ is hydrogen, hydroxy or methyl;

$R_3$ is hydrogen, hydroxy or methyl;

n is zero or 1;

$R_4$ is an alkyl of at least two carbon atoms, hydroxyalkyl or pyridyl when $R_1$ is phenyl, $R_2$ is hydrogen and n=0; and $R_4$ is alkyl, hydroxyalkyl or pyridyl in any other case.

* * * * *